US007469511B2

(12) United States Patent
Wobber

(10) Patent No.: US 7,469,511 B2
(45) Date of Patent: Dec. 30, 2008

(54) MASONRY ANCHORING SYSTEM

(75) Inventor: Stephen F. Wobber, Vancouver, WA (US)

(73) Assignee: The ECI Group, LLC, Vancouver, WA (US)

( * ) Notice: Subject to any disclaimer, the term of this patent is extended or adjusted under 35 U.S.C. 154(b) by 723 days.

(21) Appl. No.: 10/774,160

(22) Filed: Feb. 6, 2004

(65) Prior Publication Data

US 2005/0210800 A1 Sep. 29, 2005

(51) Int. Cl.
*E04B 9/00* (2006.01)
*E04B 1/38* (2006.01)
*E04B 1/16* (2006.01)

(52) U.S. Cl. ..... 52/474; 52/506.1; 52/710; 52/565; 52/354; 52/712; 52/713; 52/655.1; 52/293.3; 52/378; 52/379; 52/513

(58) Field of Classification Search ..... 52/474, 52/506.1, 710, 565, 354, 699, 713, 712, 655.1, 52/293.3, 378, 379, 513, 737.6, 735.1, 736.4; 138/145

See application file for complete search history.

(56) References Cited

U.S. PATENT DOCUMENTS 2,338,328 A * 1/1944 Handel ..... 52/699
2,787,037 A * 4/1957 Hobbs ..... 403/321
2,966,708 A * 1/1961 Freeman, Jr. ..... 52/696
3,259,148 A * 7/1966 Krengel et al. ..... 138/145
4,021,990 A 5/1977 Schwalberg
4,464,074 A * 8/1984 Green et al. ..... 403/192
4,598,518 A 7/1986 Hohmann
4,606,163 A * 8/1986 Catani ..... 52/434
4,622,796 A 11/1986 Aziz
4,738,070 A 4/1988 Abbott
4,885,884 A * 12/1989 Schilger ..... 52/354
4,955,172 A * 9/1990 Pierson ..... 52/710
5,035,099 A * 7/1991 Lapish ..... 52/713
5,347,781 A * 9/1994 Hanlon ..... 52/379
5,454,200 A * 10/1995 Hohmann ..... 52/513
5,634,310 A 6/1997 Hohmann
5,816,008 A * 10/1998 Hohmann ..... 52/565
6,209,281 B1 * 4/2001 Rice ..... 52/714
6,279,283 B1 8/2001 Hohmann
6,851,239 B1 2/2005 Hohmann
6,925,768 B2 8/2005 Hohmann

OTHER PUBLICATIONS

Dur-O-Wal, *Brochure 04082/DUR*, Buyline 4961, 2000.
Halfen Anchoring Systems, *Brochure 03150/HAL*, BuyLine 8419, 1999.
Hohmann & Barnard, Inc., "*We Anchor the World*" *Brochure 04082/HOH*, Buyline 1823, 2002.

* cited by examiner

*Primary Examiner*—Richard Chilcot, Jr.
*Assistant Examiner*—Mark R Wendell
(74) *Attorney, Agent, or Firm*—Christensen O'Connor Johnson Kindness PLLC

(57) ABSTRACT

A masonry coupling system for use in commercial and residential construction is described. In one aspect, the invention includes an anchor channel mounted on a structure. The masonry coupling system further includes a key that interfaces the masonry veneer and interlocks with an anchor channel mounted on a structure.

32 Claims, 8 Drawing Sheets

MASONRY ANCHORING SYSTEM

FIELD OF THE INVENTION

This invention relates generally to an anchoring system, and more particularly, to an anchoring system that couples masonry exterior to a structure so as to inhibit undesired forces from rending the masonry exterior from the structure.

BACKGROUND OF THE INVENTION

The use of masonry veneer on a timber frame, steel frame, concrete masonry units ("CMU"), or concrete building is popular in building design because it is cost effective and provides an aesthetically pleasing appearance. Masonry veneer provides a number of significant benefits, acting as a rain screen, a thermal barrier, and a sound barrier. Many masonry veneers do not have the necessary structural integrity to accommodate the loads that can be imposed on them, such as wind and seismic forces. Therefore, the masonry veneer must be "tied" back to a structural backup wall that will carry the imposed loads. The masonry veneer must be continuously supported at regular vertical and horizontal intervals with masonry anchors because without continuous support, the masonry veneer may become overstressed, leading to vertical cracking and possible fracture. For commercial construction, code requirements mandate the use of a minimum gauge of steel for masonry anchors, a minimum spacing between masonry anchors, and the use of hot dip galvanized steel in manufacturing masonry anchors to prevent corrosion.

Numerous products have been developed for the purpose of providing a connection between a structural backup wall and a masonry veneer. Most of the products available consist of a two-piece system consisting of an anchor plate which is attached to a stud of a structural backup wall and a separate brick tie which is inserted into the anchor plate and is mortared between two sections of brick veneer. FIG. 1A shows a perspective view of a portion of a commercial building 110, illustrating an anchor plate system 100 commonly used in the construction industry to anchor a masonry veneer to the exterior of structural backup walls. As shown in FIG. 1A, individual anchor plates 102 are installed in a grid pattern prior to laying a masonry veneer, such as a brick veneer 106. As sections of the brick veneer 106 are installed, brick ties 104 are inserted into the installed anchor plates 102. Reinforcement wire 108 is then strung across the brick ties 104 and both are mortared into the joint between sections of the brick veneer 106, thus creating the system 100 that anchors the masonry veneer to the exterior of backup structural walls to comply with local building codes. The system 100 illustrated in FIG. 1A has several disadvantages. Installation of the system 100 is time consuming and expensive because it requires a mason contractor to laboriously lay out a grid by striking lines to determine where to place numerous anchor plates 102, then physically attach each anchor plate 102 to a structural backup wall with at least two screws per anchor plate 102. The two piece anchor system comprising the anchor plate 102 and the brick tie 104 allows for movement of the masonry veneer 106. Further, the system 100 does not allow for flexibility during construction due to prepositioning of the fixed anchor plates 102. The most pernicious problem of all, however, is that the holes created by the screws used to mount the anchor plates 102 to the structural backup wall create an entry point for moisture and air to get into the cavity between the structural backup wall and the brick veneer 106, leading to mold growth, corrosion of the anchors, and lower insulation values.

Another system 120 used primarily in residential construction, is illustrated in FIG. 1B. As shown, the system 120 uses an elongated slot 122 with tightly rolled edges 126 to engage an anchor tie 128 which has a T-shaped portion 124. One major drawback of the system 120 is that the system 120 cannot be used in commercial construction in most areas of the country due to building code restrictions. Due to the tightly rolled edges 126 of the elongated slot 122, the elongated slot 122 can only be manufactured out of light gauge steel. Therefore, the elongated slot 122 cannot be hot dip galvanized without bowing and other structural defects. Further, the pronged teeth of the anchor tie 128 bite into the slot 122 and weaken it when the system 120 is subjected to tension and compression forces, such as seismic forces, leading to load failure. Finally, the system 120, like the system 100, does not provide a means for protecting against air and moisture entering the cavity between the masonry veneer and the structural backup wall.

Therefore, there is a need for a better system that couples a masonry veneer to a structure and inhibits undesired environmental intrusion, while avoiding or reducing the foregoing and other problems associated with existing masonry anchoring systems.

SUMMARY OF THE INVENTION

In accordance with this invention, a system, device, and method for coupling a masonry veneer to a structure is provided. The device form of the invention includes, in a system for coupling a masonry veneer to a structure, an anchor mounted on the structure. The anchor includes a channel body having a channel bottom connected to two walls. A first wall is projected substantially perpendicular to the bottom, and a second wall is in parallel to the first wall. The second wall has a proximal end and a distal end. The proximal end is projected substantially perpendicular to the channel bottom. The distal end is projected toward the channel bottom at an acute angle to define a negative slope. In some embodiments, the distal end of the second wall is projected toward the channel bottom at an angle of about 30 degrees to about 60 degrees. In various embodiments, the distal end is projected at an angle of about 45 degrees. In other embodiments, the channel body is at least 1 inch in length. In a number of embodiments, the outer surface of the channel body is coated with an adhesive layer. In yet other embodiments, the channel body comprises a galvanized coating.

In accordance with further aspects of this invention, another device form of the invention includes, in a system for coupling a masonry veneer to a structure, a key that interfaces the masonry veneer and interlocks with an anchor mounted on the structure. The key has a substantially flat body with two ends. A first end has a slit to interlock with the anchor and a second end has one or more openings for mortar capture. In some embodiments, the slit is slanted towards the anchor at an acute angle. In other embodiments, the slit is slanted towards the anchor at about a 45 degree angle. In various embodiments, the first side of the first end of the key has the slit to engage the anchor and the second side of the first end of the key has a side cut.

In accordance with further aspects of this invention, a system form of the invention includes a masonry coupling system. The masonry coupling system includes at least one anchor mounted on a structure for coupling a masonry veneer to a structure. Each anchor includes a channel body having a bottom connected to two walls. A first wall of the two walls is projected substantially perpendicular to the bottom, and a second wall of the two walls is in parallel to the first wall. The second wall has a proximal end and a distal end. The proximal end is projected substantially perpendicular to the bottom and the distal end is projected toward the channel bottom at an acute angle to define a negative slope. The masonry coupling system further includes at least one key. Each key interfaces the masonry veneer and interlocks with the anchor mounted on the structure. Each key includes a substantially flat body with two ends. A first end of the substantially flat body has a slit to interlock with the anchor. A second end of the substantially flat body has one or more openings for mortar capture.

In accordance with this invention, a method form of the invention includes a method for manufacturing a masonry coupling system. The method includes shaping a first form to create an anchor. The anchor includes a channel body having a channel bottom connected to two walls. A first wall of the two walls is projected substantially perpendicular to the channel bottom, and a second wall is in parallel to the first wall. The second wall has a proximal end and a distal end. The proximal end is projected substantially perpendicular to the channel bottom. The distal end is projected toward the channel bottom at an acute angle to define a negative slope. The method includes dipping the shaped form into a molten substance to form an alloy coating so as to provide cathodic protection. In some embodiments, the method further includes shaping a second form to create a key. The key has a substantially flat body with two ends. A first end of the substantially flat body has a slit to interlock with the anchor. A second end of the substantially flat body has one or more openings for mortar capture.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Generally described, the present invention provides a system and device for anchoring masonry veneer to a structure, such as, for example, an interior wall or exterior wall of a building (commercial or residential). Masonry veneers are a popular construction design for commercial buildings. Various embodiments of the present invention provides a coupling system to securely anchor a masonry veneer to structural walls that complies with commercial building codes. Preferably, the coupling system eases the toilsome effort with which a mason installs masonry veneers. Various embodiments of the invention inhibit moisture intrusion through the coupling system. In various embodiments, an anchor, which extends longitudinally, is mounted on a wall of a structure. A number of keys that interface the masonry veneer interlock with the anchor mounted on the wall of the structure.

The shape of the anchor and key provide several unexpected advantages over other anchoring systems. For example, the elongated channel body of the anchor allows for flexibility in positioning keys interfacing a masonry veneer during construction. As another example, the three sided channel body shape of each anchor allows each key to interlock with, and strengthen the anchor channel as the key interfacing the masonry veneer is tensioned. One other example is that the anchor and key of the invention may be manufactured from heavy gauge steel. As a further example, the shape of one of the walls of the anchor serves as a strengthening gusset and prevents the elongated channel body of the anchor from bowing during galvanization. In various embodiments of the present invention, the system for coupling masonry veneer to a structure, including the anchor and key of the invention, may be used to comply with commercial building codes.

The detailed description is divided into five sections. In the first section, a brief introductory overview of the system for coupling a masonry veneer to a structure is provided. In the second section, a device in the form of an anchor mounted on a structure, in accordance with one aspect of the invention is presented. In the third section, a device in the form of a key that interfaces masonry veneer and interlocks with an anchor in accordance with one aspect of the invention is presented. In the fourth section, a masonry coupling system is provided. Finally, in the fifth section, a method for manufacturing a masonry coupling system is described.

Figure 1A:
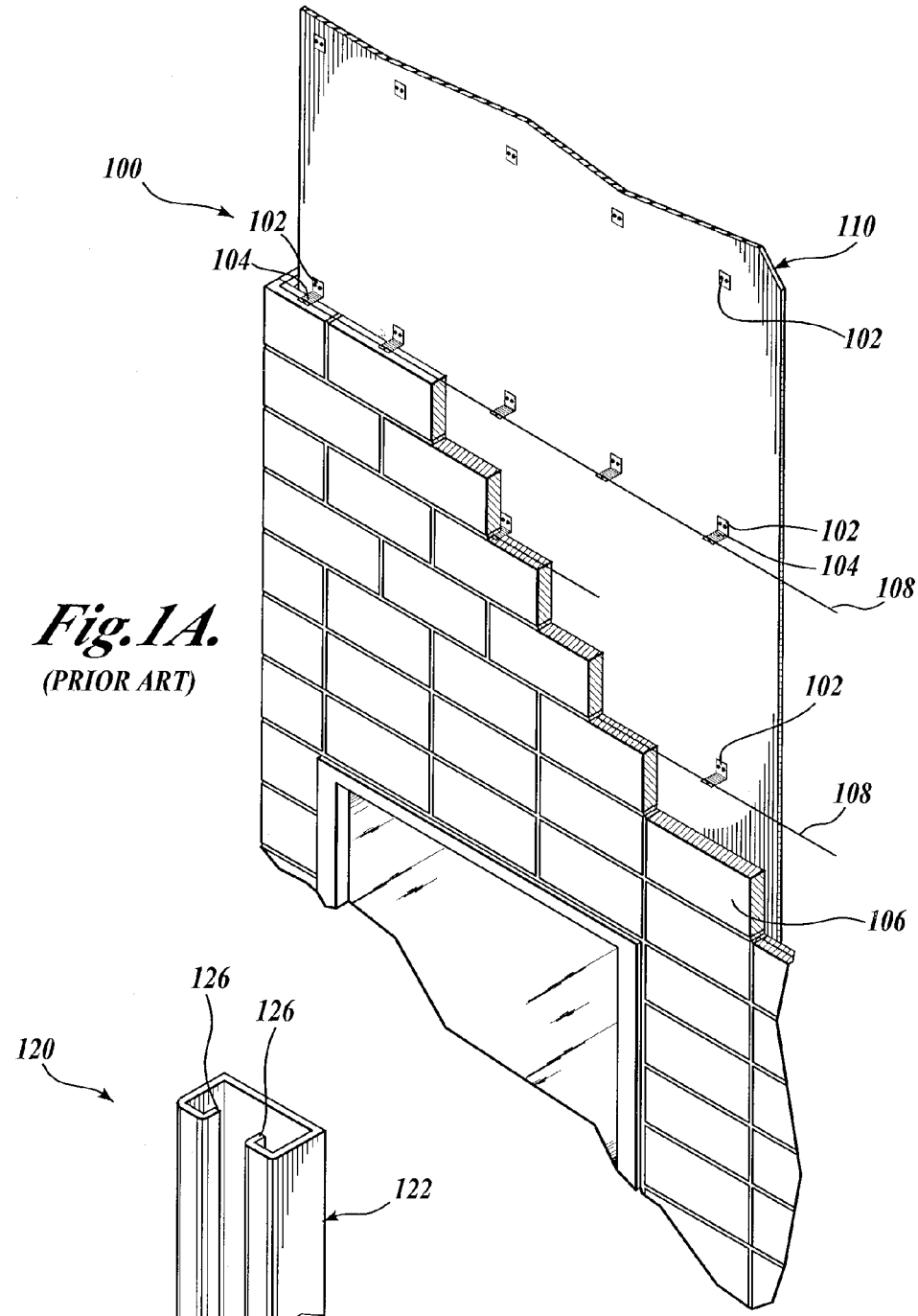
Fig. 1A. (PRIOR ART)
FIG. 1A is a perspective view of a portion of a commercial building, illustrating an anchor plate system commonly used in the construction industry to anchor masonry veneer to the exterior of structural walls.
Figure 1B:
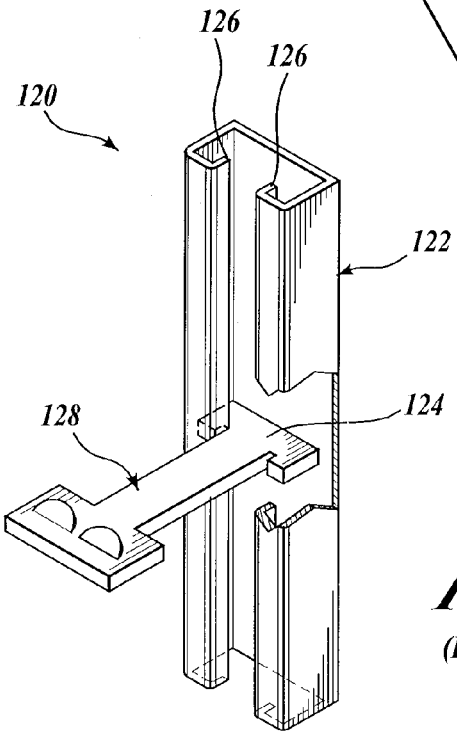
Fig. 1B. (PRIOR ART)
FIG. 1B is a perspective view of an anchor system for residential use that uses an elongated slot with tightly rolled edges to engage an anchor tie with a T-shaped portion.
Figure 2A:
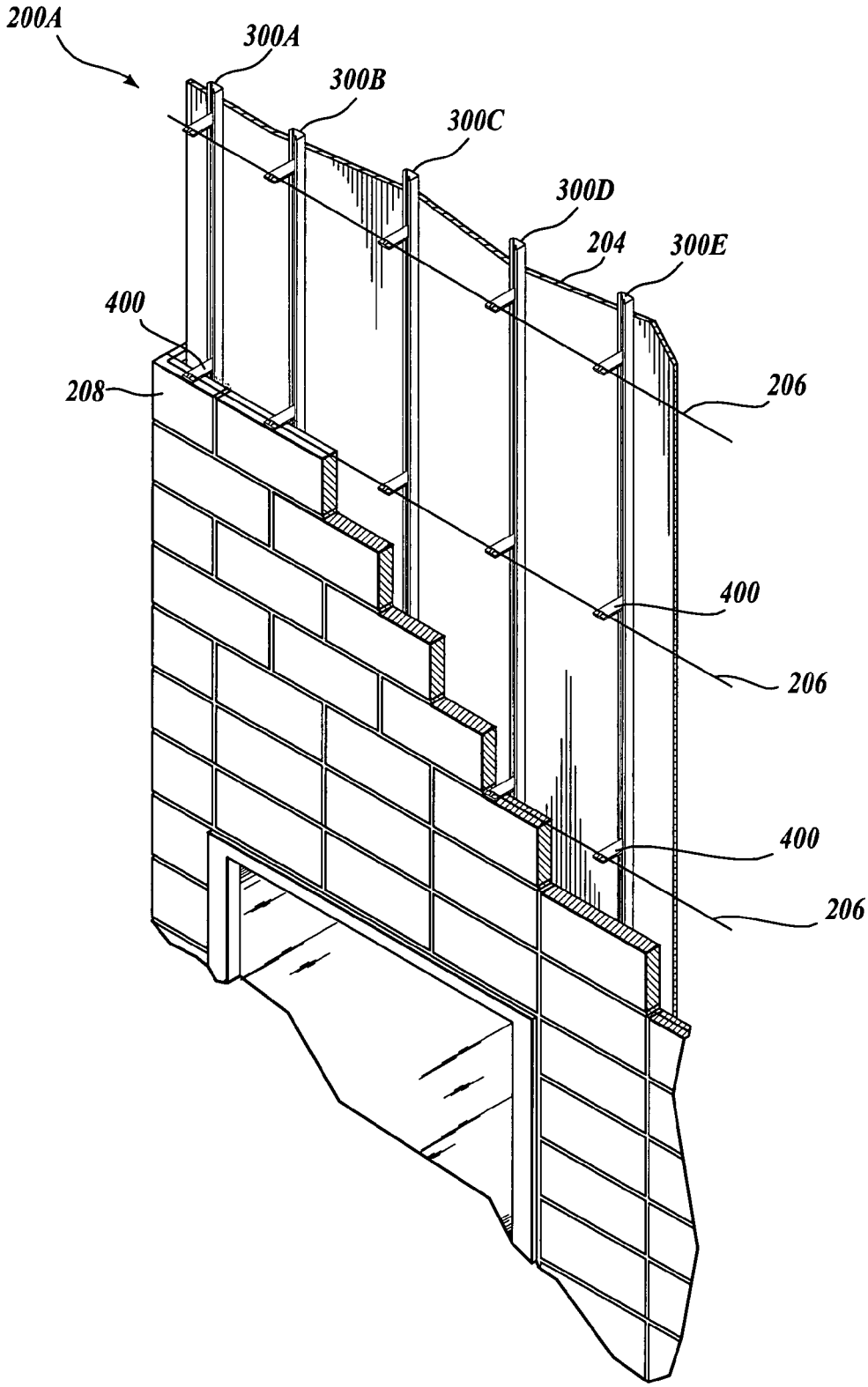
FIG. 2A is a perspective view of an exemplary masonry coupling system, illustrating a portion of a brick veneer anchored to a structure.

For ease of understanding, a brief overview of certain aspects of the exemplary masonry coupling system 200A is illustrated by FIG. 2A. Briefly described, the masonry coupling system 200A includes at least one anchor 300A-E mounted a structure 204 and at least one key 400 that interfaces a section of a masonry veneer 208 and interlocks with the anchor 300A-E to couple the masonry veneer 208 to the structure 204.

The masonry coupling system 200A and devices are suitable for coupling masonry veneers to a structure in commercial and residential applications, allow for efficient installation and flexibility during construction, and are resistant to tension and compression forces. The masonry coupling system 200A and devices of various embodiments of the present invention may be used in the construction of any building (for example, concrete, CMU, wood frame and steel frame buildings), whose exterior is covered by a masonry veneer. Accordingly, the system and devices of various embodiments of the present invention may be used by anyone involved in the construction of a building, such as, construction workers, contractors, masons, bricklayers, masonry contractors, and laypersons. Various embodiments of the present invention are particularly beneficial to masonry contractors, allowing for efficient installation of an anchoring system in order to maximize time available for laying brick. In addition, various embodiments of the present invention require fewer fasteners per section of veneer than other anchoring systems. As described in more detail below, the anchor design allows for flexibility in the construction process and allows the masonry coupling system 200A to be fabricated out of heavy gauge steel and may be hot dip galvanized to comply with commercial building codes.

Figures 3A, 3B, 3C:
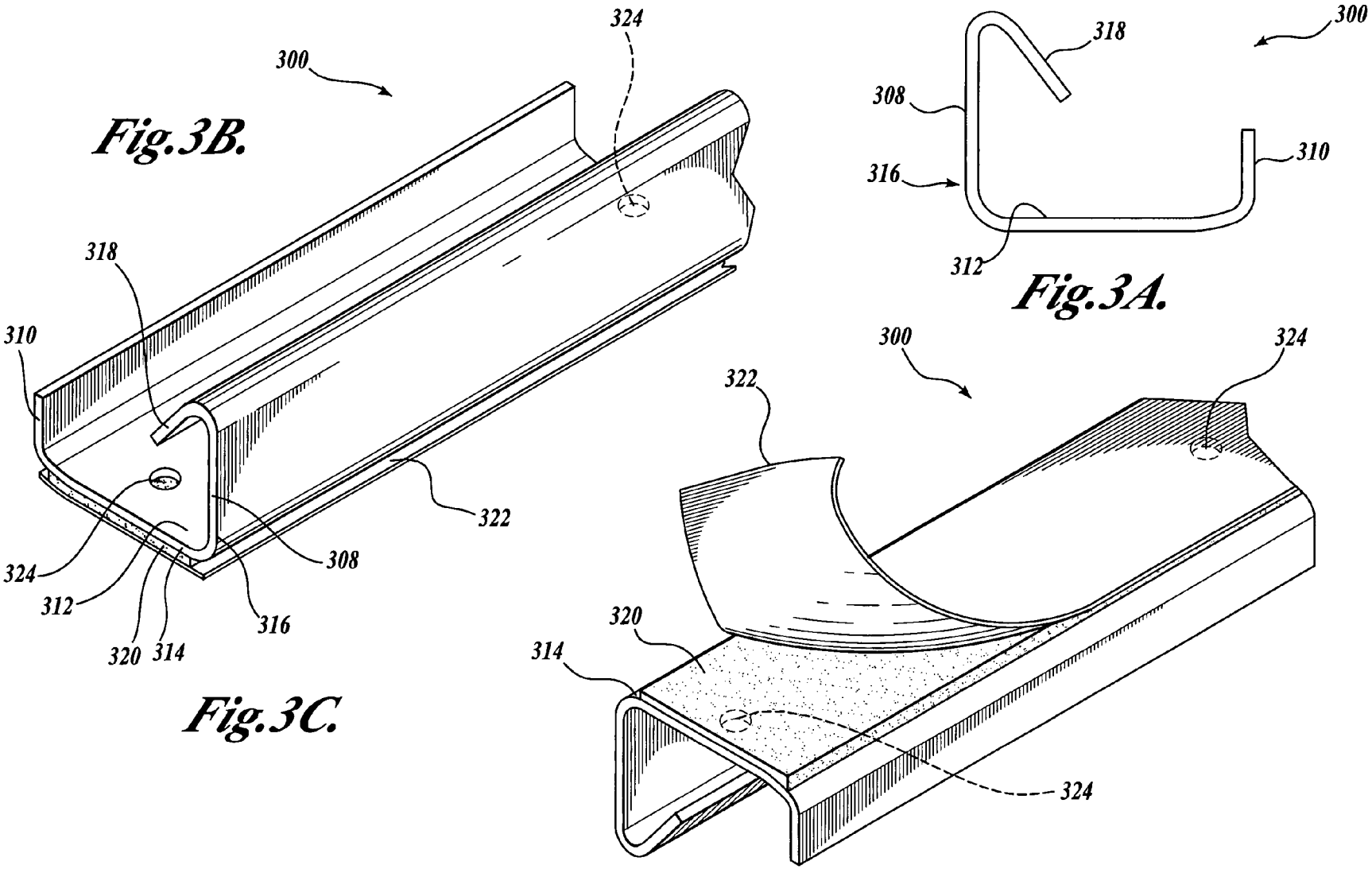
FIG. 3A is a cross-sectional view of a representative embodiment of an anchor of the invention illustrating the three sided anchor body with one wall of the channel comprising a distal end projecting toward the channel bottom at an acute angle to define a negative slope.
FIG. 3B is a perspective view of an exemplary anchor, illustrating the channel body containing holes for receiving fasteners to vertically attach the anchor to a structure.
FIG. 3C is another perspective view of the exemplary anchor, illustrating an adhesive layer coated on the outer surface of the channel and a peelable backing strip covering the adhesive layer.

FIG. 3A illustrates an exemplary anchor 300 in accordance with one aspect of the invention. The exemplary anchor 300 comprises a body having a channel bottom 312 connected to two walls. A first wall 310 is projected substantially perpendicular to the channel bottom 312. The second wall 308 of the anchor 300 includes a proximal end 316 and a distal end 318. The proximal end 316 is projected substantially perpendicular to the channel bottom 312. The distal end 318 is projected toward the channel bottom 312 at an acute angle to define a negative slope.

Various suitable dimensions of the anchor 300 can be used to accommodate particular applications and/or building code requirements. The elongated shape of the anchor 300 is illustrated in FIG. 3B. The anchor 300 may be any length suitable for coupling a masonry veneer to a structure. The elongated body of the anchor 300 allows flexibility in positioning a key that interfaces the masonry veneer. An individual anchor 300 may couple multiple sections of masonry veneer to a structure. Typically, masonry veneer is commercially available in standardized panel sizes, such as 16 inch by 24 inch, or 24 inch by 24 inch. Therefore, an exemplary range for a suitable length for the anchor 300 would be from about 1 inch to about 20 feet. In some embodiments, the length of the anchor 300 is at least 5 feet. In other embodiments, the length of the anchor 300 is from about 5 feet to about 10 feet for manufacturing ease during hot dip galvanization. Typically, steel forms are hot dip galvanized in lengths up to about 10 feet due to constraints in the hot dip galvanization process. However, it should be understood that the anchor 300 of the invention may be longer than 10 feet.

The width of the channel bottom 312 can be any width suitable for mounting of the anchor 300 to a structure. See FIG. 3A. Typically, the channel bottom 312 is wider than the height of the second wall 308. For example, in some embodiments, the channel bottom 312 can be from about ¾ inch to about 6 inches wide. In other embodiments, the channel bottom 312 is about 1 inch wide.

With continued reference to FIG. 3A, the first wall 310 may be projected substantially perpendicular from the channel bottom 312 to any suitable height that allows the anchor 300 to be mounted on a structure and couple a masonry veneer to the structure. Typically, the first wall 310 projects substantially perpendicular to the channel bottom 312 in parallel to, and at about one half the height of, the proximal end 316 of the second wall 308. Illustrative examples of suitable heights for the first wall 310 include a range from about ¼ to about 2 inches. In some embodiments, the first wall 310 projects about $6/16^{th}$ inches from the channel bottom 312.

Referring to FIGS. 3A and 3B, the proximal end 316 of the second wall 308 projects substantially perpendicular from the channel bottom to any suitable height that allows the anchor 300 to be mounted on a structure and couple a masonry veneer to the structure. In some embodiments, the proximal end 316 of the second wall 308 projects substantially perpendicular to the channel bottom 312 in parallel to and at about twice the height of the first wall 310. Illustrative examples of suitable heights for the proximal end 316 of the second wall 308 include a range of from about ½ inch to about 4 inches. In some embodiments, the proximal end 316 of the second wall 308 projects about ¾ inch from the channel bottom 312.

With continued reference to FIGS. 3A and 3B, the distal end 318 of the second wall 308 projects toward the channel bottom 312 at an acute angle to define a negative slope. The acute angle may be any angle less than 90 degrees that will allow an instrument that interfaces masonry veneer, such as a key, to interlock with the anchor 300. For example, in some embodiments, the anchor 300 comprises the second wall 308 wherein the distal end 318 projects toward the channel bottom 312 at an angle in the range of from about 30 degrees to about 60 degrees. In other embodiments, the angle ranges from about 40 degrees to about 50 degrees. In some other embodiments, the anchor 300 comprises the second wall 308 wherein the distal end 318 projects toward the channel bottom 312 at about 45 degrees. The distal end 318 of the second wall 308 projects toward the channel bottom 312 to define a negative slope. As used herein, negative slope refers to a slope of less than zero degrees in reference to a horizontal plane, such as the channel bottom 312.

The depth of projection of the distal end 318 may be any length that will allow an instrument, such as a key, to interlock with the anchor 300. For example, in some embodiments, the distal end 318 may project to a depth in the range of from about ¼ inch to about 3 inches. In other embodiments, the distal end 318 projects about 6/16 inch toward the channel bottom 312.

In a preferred embodiment, the anchor 300 has the following approximate dimensions: the channel bottom 312 is about 1 inch wide, the first wall 310 is about 6/16 inch high, the proximal end 316 of the second wall 308 is about ¾ inch high, and the distal end 318 of the second wall 308 projects about ½ inch towards the channel bottom 312 at about a 45 degree angle. In one embodiment, the anchor 300 has an elongated shape of about 5 feet in length. In another embodiment, the anchor 300 has an elongated shape of about 10 feet in length.

Referring again to FIG. 3B, some embodiments of the anchor 300 include a plurality of fastener holes 324 through the channel bottom 312 along its length. The fastener holes 324 are sized to suit various fasteners, such as screws or bolts, with holes of a diameter such as, 5/16 inch to 1/14 inch in diameter. The fastener holes 324 can be spaced at any interval suitable to secure the anchor 300 to a structure. For example, the fastener holes may be spaced at intervals of between about 12 inches and 24 inches.

The outer surface of the channel bottom 314 is shown in FIG. 3C. In some embodiments, the anchor 300 further comprises an adhesive layer 320 over the outer surface of the channel bottom 314. The adhesive layer 320 is useful both for positioning the anchor 300 prior to installation and for holding the anchor 300 in place during installation. In some embodiments, the adhesive layer 320 comprises a weatherproof protective membrane that acts as a self-sealing gasket around a fastener, preventing air and moisture from entering a structure. The adhesive layer 320 is applied over the outer surface 314, covering over the fastener holes 324. During installation of the anchor 300, fasteners, such as screws, are positioned over the fastener holes 324 and drilled through the adhesive layer 320, which surrounds the protruding surface of the fastener and acts as a weatherproof self-sealing gasket around the fastener.

The adhesive layer 320 may be made of any suitable weatherproof materials. One suitable material includes rubberized asphalt manufactured from a bituminous resin, but others can be used. Rubberized asphalts combine the water repellency of petroleum with the elastomeric nature of organic rubber to create a flexible waterproofing membrane. Rubberized asphalt is commercially available in "peel and stick" rolls or in bulk containers that are hot applied (such as peel and stick products available from W.R. Grace Company, New York). In some embodiments, the anchor 300 further comprises a peelable protective backing 322 covering the adhesive layer 320, which is removed prior to installation.

Figure 4C:
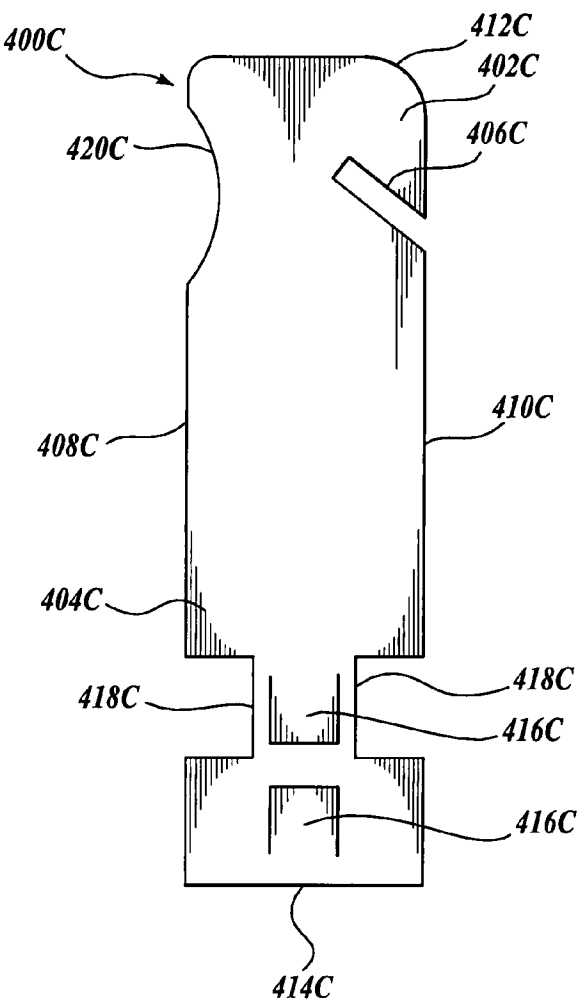
FIG. 4C is a front view of a key, in accordance with one embodiment of the invention, illustrating the first side of the first end of the key having a slit to interlock with an anchor, a second side of the first end of the key having a side cut, and the second end of the key having a seismic punch and a mortar punch.
Figure 5:
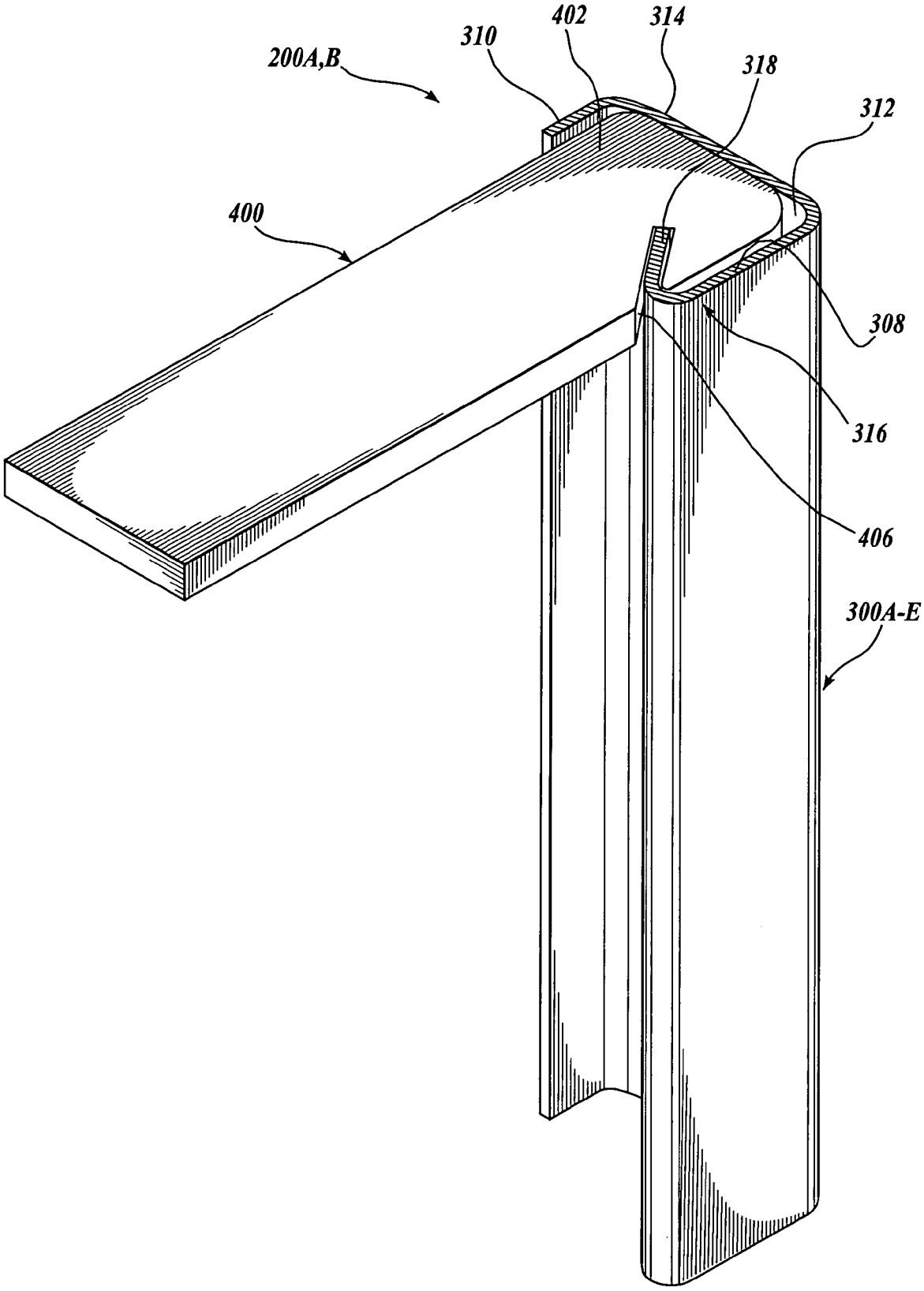
FIG. 5 is a perspective view of an exemplary masonry coupling system of the invention, illustrating an anchor vertically positioned with a key interlocked in the anchor.

Several unexpected advantages have been discovered over other anchor plate systems currently available in the construction industry. One advantage is provided by the shape of the first wall 310, which serves to strengthen the entire anchor body 300 by allowing for load transfer from an instrument that interfaces masonry veneer, such as a key, to the corner between the first wall 310 and the channel bottom 312. FIG. 5 shows a perspective view of the exemplary anchor 300A-E interlocked with a key 400. Each key 400 interlocks with the anchor 300A-E in a position perpendicular to the channel bottom 312 and lodges in the corner between the first wall 310 and the channel bottom 312. Once tensioned, each key 400 interlocked with the anchor 300A-E provides lateral support and reinforcement at regular intervals to the entire length of the anchor body 300A-E. In some embodiments, the key 400, such as a key 400C, has a side cut 420C on a first end 402C which allows for load transfer to the corner of the key 400C engaged in the anchor 300A-E. See FIG. 4C. An additional advantage afforded by the shape of the anchor 300A-E is that the distal end 318 of the second wall 308 acts as a strengthening gusset to prevent bowing of the anchor 300A-E during hot dip galvanization.

The anchor 300 may be constructed of any suitable non-corrosive material such as galvanized bright steel, hot dipped steel, or stainless steel. In order to maximize the corrosion resistant properties of the anchor 300 as well as minimize cost, it is preferable to manufacture the anchor 300 from bright steel followed by hot dip galvanization. Typically, in order to hot dip galvanize an elongated section of steel, such as the anchor 300, the steel must be of sufficient thickness and shape to resist bowing due to heat. For example, the anchor 300 may be constructed of steel in the range of about 11 gauge to about 20 gauge. As disclosed herein, second wall 308 and distal end 318 also serves as a stiffening gusset to prevent bowing of channel body 326 during hot dip galvanization.

Many configurations for the key 400 are possible. Referring now to FIG. 4A, a front view of a key 400A is shown. The key 400A has a substantially flat body with a first end 402A and a second end 404A. The first end 402A has a slit 406A to interlock with an anchor, such as, the anchor 300. The key 400A has a first side 408A, a second side 410A, a top 412A and a bottom 414A. The slit 406A can either be cut into the first side 410A or, alternatively, the slit 406A can be cut into the second side 408A of the key body. The slit 406A generally slants upwards towards the first end 402A of the key 400A, and may be cut at any angle suitable to interlock with an anchor mounted on a structure, such as an acute angle. Illustrative examples of suitable angles for the slit 406A include a range from about 30 degrees to about 60 degrees. Other suitable angles range from about 40 degrees to about 50 degrees. In some embodiments, the slit 406A is cut at about a 45 degree angle. The slit 406A may be cut to any depth suitable to interlock with an anchor. In some embodiments, the slit 406A is cut to a depth up to but not more than half the width of the key 400A.

The body of the key 400A may be any width that is suitable to interlock with an anchor. Illustrative examples of suitable widths for the body of the key 400A include a range from about ¾ inch to about 6 inches, but preferably from about 1 inch to 2 inches. In some embodiments, the top 412 of the key 400A has rounded edges to ease insertion into an anchor and to allow the top 412 of the key 400A to securely fit into an anchor channel.

The key 400A may have any length suitable to allow it to interlock with a mounted anchor and interface with the masonry veneer. Illustrative examples of suitable lengths for the key 400A include a range from about 2 inches to about 10 inches, more preferably from about 2 inches to about 6 inches. In some embodiments the length of the key 400 is about 3½ inches.

Figure 4B:
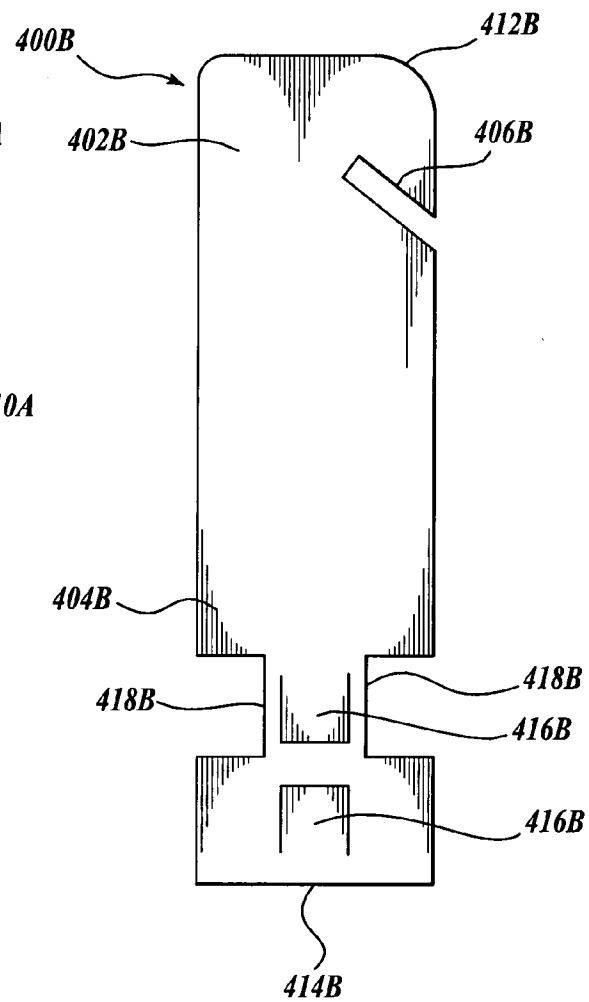
FIG. 4B is a front view of a key, in accordance with one embodiment of the invention, illustrating the first end of the key having a slit to interlock with an anchor and the second end of the key having a seismic punch and a mortar punch.
Figure 4A:
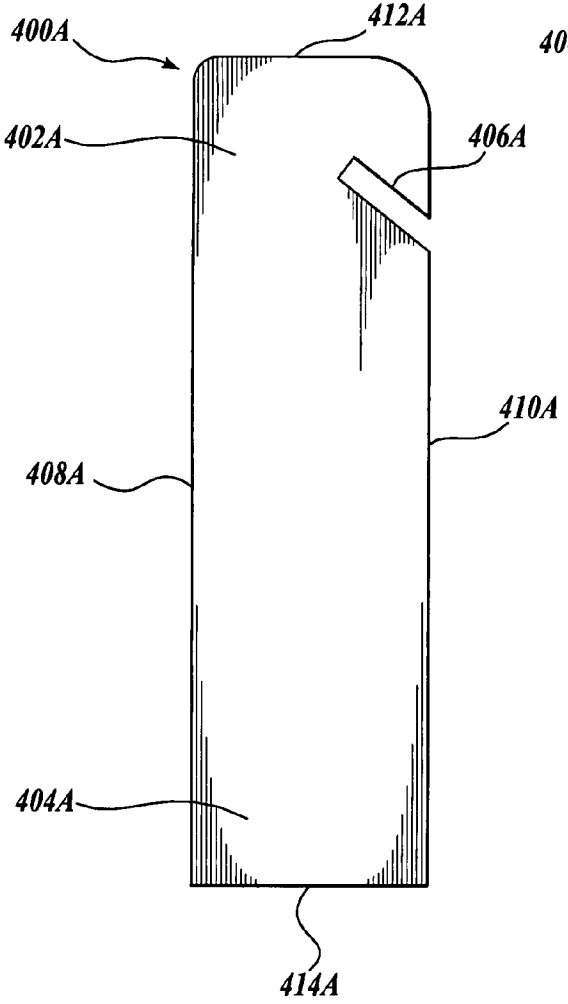
FIG. 4A is a front view of an exemplary key, illustrating the first end of the key having a slit to interlock with an anchor.

Referring now to FIG. 4B, which illustrates one embodiment of a key 400B, the second end 404B of the key 400B comprises one or more openings for mortar capture. The embodiment of the key 400B depicted in FIG. 4B comprises a seismic punch 416B to secure reinforcing wire and mortar capturing tabs 418B. Although not uniformly required, in seismic zones many building codes include a reinforcement wire provision. Accordingly, the key 400B may comprise a seismic punch 416B to secure to at least one reinforcement wire which is also embedded in the mortar of the bed joint between sections of veneer. In some embodiments, the key 400B may also include mortar capturing tabs 418B. A wide variety of designs for the second end 404B of the key 400B (comprising various configurations of seismic punches) for connecting with reinforcement wires and mortar capturing tabs are utilizable.

FIG. 4C illustrates another embodiment of a key 400C. In this embodiment, the second side 410C of the first end 402C of the key 400C comprises the slit 406C to interlock with an anchor and the first side 408C of the first end 402C of the key 400C has a side cut 420C. The size and shape of the side cut 420C can be any size and shape that allows for load transfer to the first end 402C of the key 400C while it is engaged in an anchor.

The key 400A,B,C may be constructed from any suitable non-corrosive material, such as, for example, galvanized bright steel or stainless steel. The key 400A,B,C may be made from any suitable gauge of steel, such as, steel of 11 gauge to about 20 gauge. In order to enhance the corrosion resistant properties of the key 400A,B,C as well as to minimize cost, it is preferable to manufacture it from bright steel followed by hot dip galvanization.

In operation of the masonry coupling system 200A,B of the invention, at least one anchor 300A-E is mounted to a structure 204 as illustrated in FIG. 2A. The structure may be an interior or exterior wall, such as, for example, a stud supported backup wall such as a drywall, a steel stud supported wall, a concrete block wall, a poured concrete wall, or a steel I-beam wall. Each anchor 300A-E is mounted to a structure 204 using any suitable fastener. In some embodiments of the masonry coupling system 200A,B as shown in FIG. 3C, the anchor 300A-E further comprises an adhesive layer 320 on the outer surface 314 covered by a peelable backing 322. In operation of these embodiments, the peelable backing 322 is removed from the anchor 300A-E prior to mounting. The adhesive layer 320 increases efficiency and ease of mounting the anchor 300A-E to a structure 204 by allowing the operator to adhere the anchor 300A-E to the structure 204 prior to mounting with fasteners. A plurality of anchors 300A-E may be used in the system 200A,B, wherein each anchor 300A-E is mounted at any suitable distance from the other anchors 300A-E to securely couple masonry veneer to a structure. The anchors 300A-E may be mounted to a structure 204 in any orientation suitable to couple masonry veneer to the structure. For example, the anchors 300A-E may be mounted to a structure 204 in a vertical or horizontal position, or the anchors 300A-E may be mounted to a structure at any angle between zero degrees and ninety degrees.

Figure 2B:
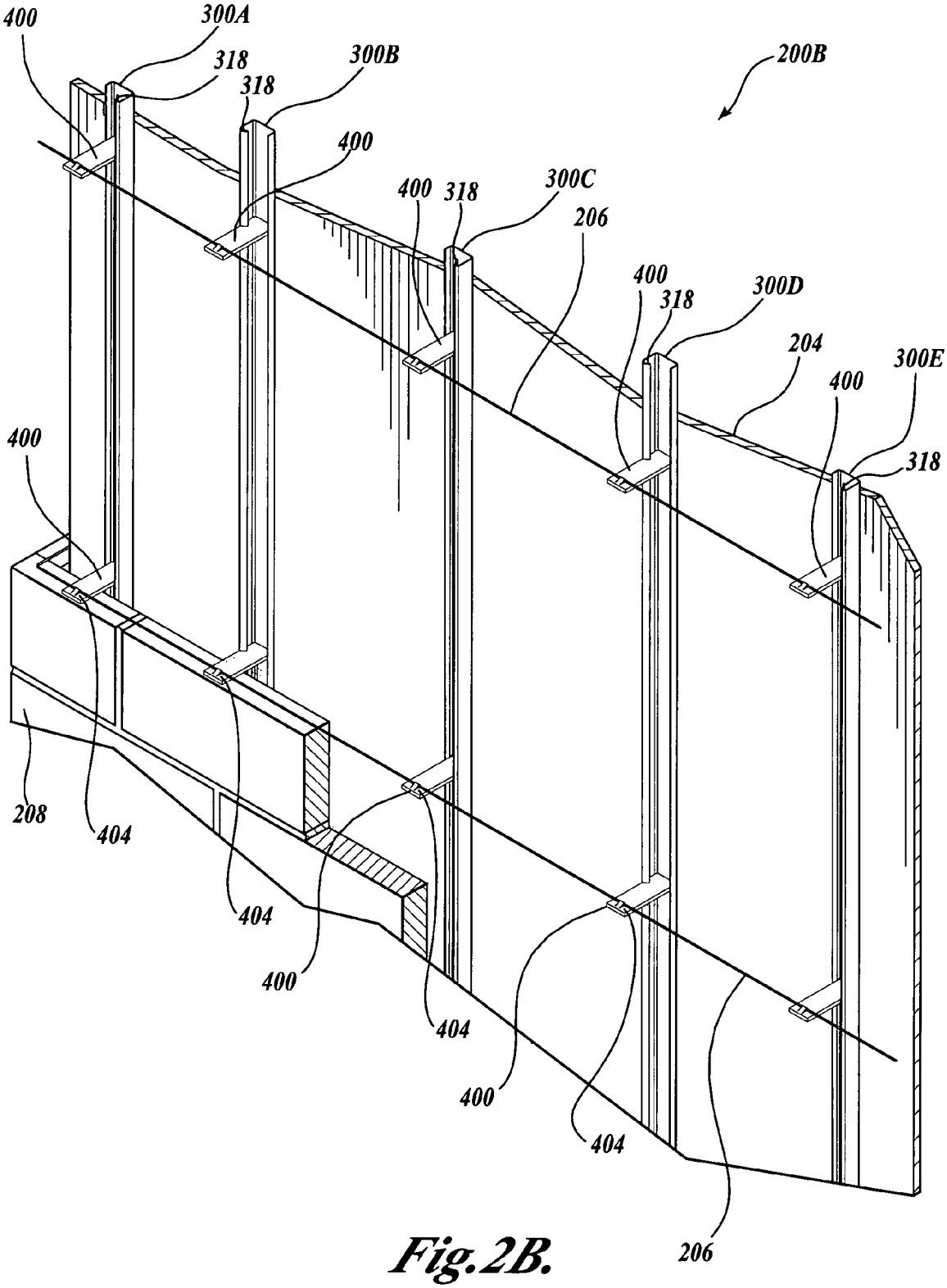
FIG. 2B is a perspective view of one embodiment of the invention, illustrating an anchor system comprising anchors mounted to a structure in alternating orientations.

In some embodiments of the masonry system 200A,B, two or more anchors 300A-E may be mounted to a structure in alternating orientations. FIG. 2B illustrates one embodiment of the masonry system 200B comprising at least two anchors 300A-E, wherein each anchor 300A-E is mounted to a structure 204 in an alternating orientation. As shown in FIG. 2B, anchors 300A,C are mounted to the structure 204 such that the second wall 308 comprising the distal end 318 of each anchor 300A,C faces the second wall 308 comprising the distal end 318 of the anchors 300B,D, and so on. Masonry system 200B provides additional stability when the system 200B is subjected to tension and compression forces, such as seismic forces.

Referring again to FIG. 2A and FIG. 2B, after at least one anchor 300A-E is mounted to the structure 204, at least one key 400 is positioned to interface with a section of masonry veneer 208 and to interlock with the mounted anchor 300A-E. Referring now to FIG. 5, the first end 402 of the key 400 is inserted towards the channel bottom 312 of the anchor 300A-E. The key 400 is then interlocked with the anchor 300A-E by interlocking the slit 406 of the key 400 with the distal end 318 of the anchor 300A-E. As shown in FIG. 2B, once the key 400 is interlocked with the anchor 300A-E, the substantially flat body of the key 400 is placed horizontally on a vertically positioned section of veneer 208 and the second end 404 of the key 400 is placed in the bed joint of the veneer and embedded in mortar. The elongated shape of the anchor 300A-E allows for flexible positioning of the key 400 during installation of the masonry veneer 208. In the masonry coupling system 200A,B, a plurality of keys 400 may be interlocked with each anchor 300A-E. In some embodiments of the masonry coupling system 200A,B, as shown in FIG. 2A and FIG. 2B, reinforcing wire 206 runs through a seismic punch 416 on the key 400 to increase mortar capture.

Figure 6:
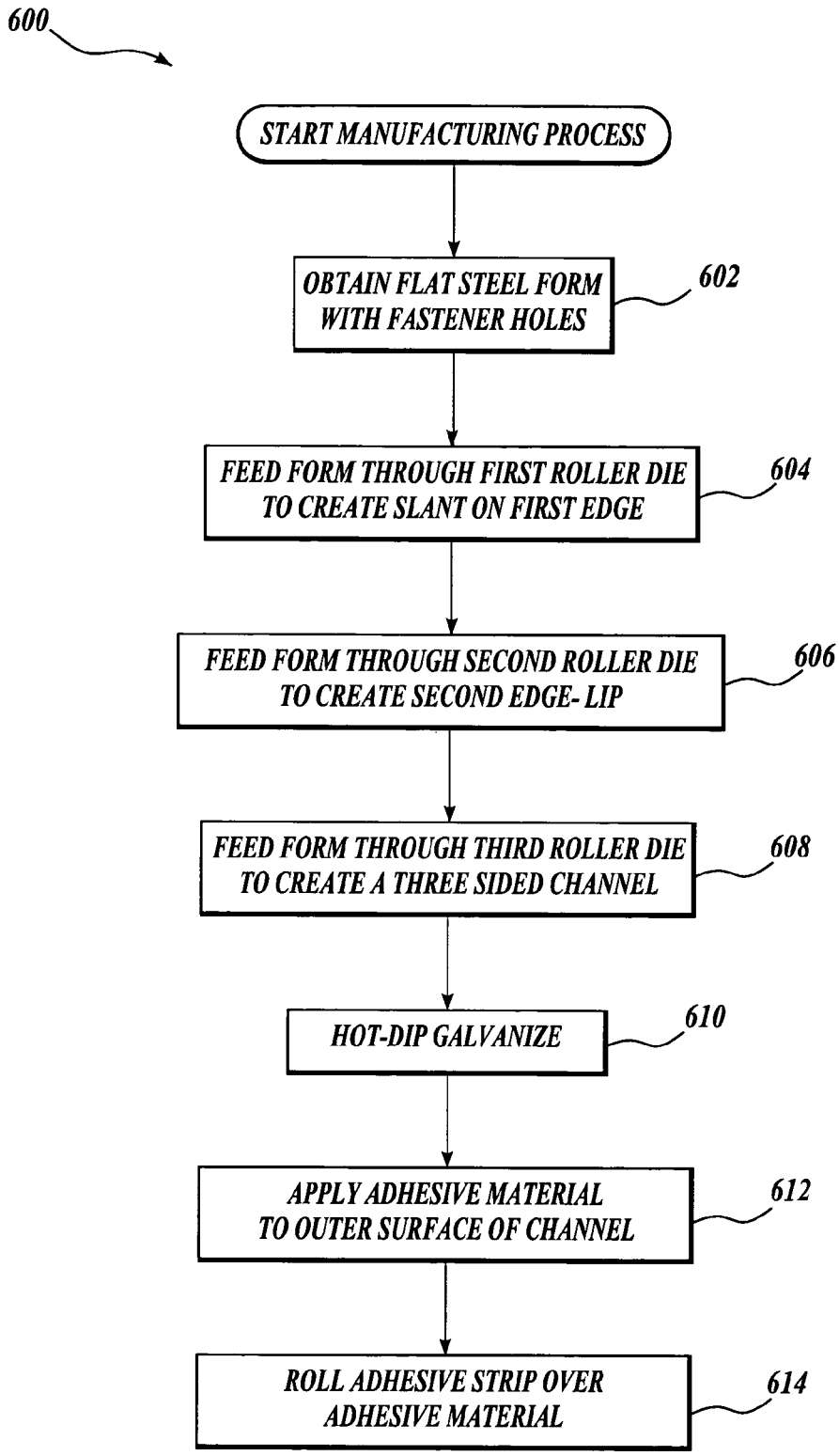
FIG. 6 is a process diagram of a method for manufacturing an anchor for a masonry coupling system in accordance with one embodiment of the present invention.

In yet another aspect, the present invention includes a method for manufacturing a masonry coupling system including shaping a first form to create an anchor. FIG. 6 shows a process diagram of a method 600 for manufacturing an anchor for a masonry coupling system in accordance with one embodiment of this aspect of the invention. From a start block, the method 600 proceeds to block 602 where the method 600 obtains a flat steel form of appropriate gauge and dimension punched with fastener holes. At block 604, the method 600 places the form through a first roller die to create a distal end of the second wall of an anchor body projected at an acute angle. The method 600 then places the form through a second roller die to create the first wall of a channel body perpendicular to the channel bottom. See block 606. The method 600, at block 608, the places the form through a third roller die to fold the form into a three-sided channel with a distal end of the second wall projecting downward toward the channel bottom at an acute angle. Proceeding to block 610, the method 600 dips the anchor into a molten substance to form an alloy coating to provide cathodic protection. The molten substance that provides cathodic protection may be any suitable substance such as a substance selected from Group 2B elements. Examples of suitable substances include zinc and cadmium.

In some embodiments, the method 600 further comprises the act of applying an adhesive layer over the length of the channel bottom of the channel body. See block 612. The method 600 further comprises the act of affixing a peelable strip of backing material over the adhesive layer. See block 614.

Figure 7:
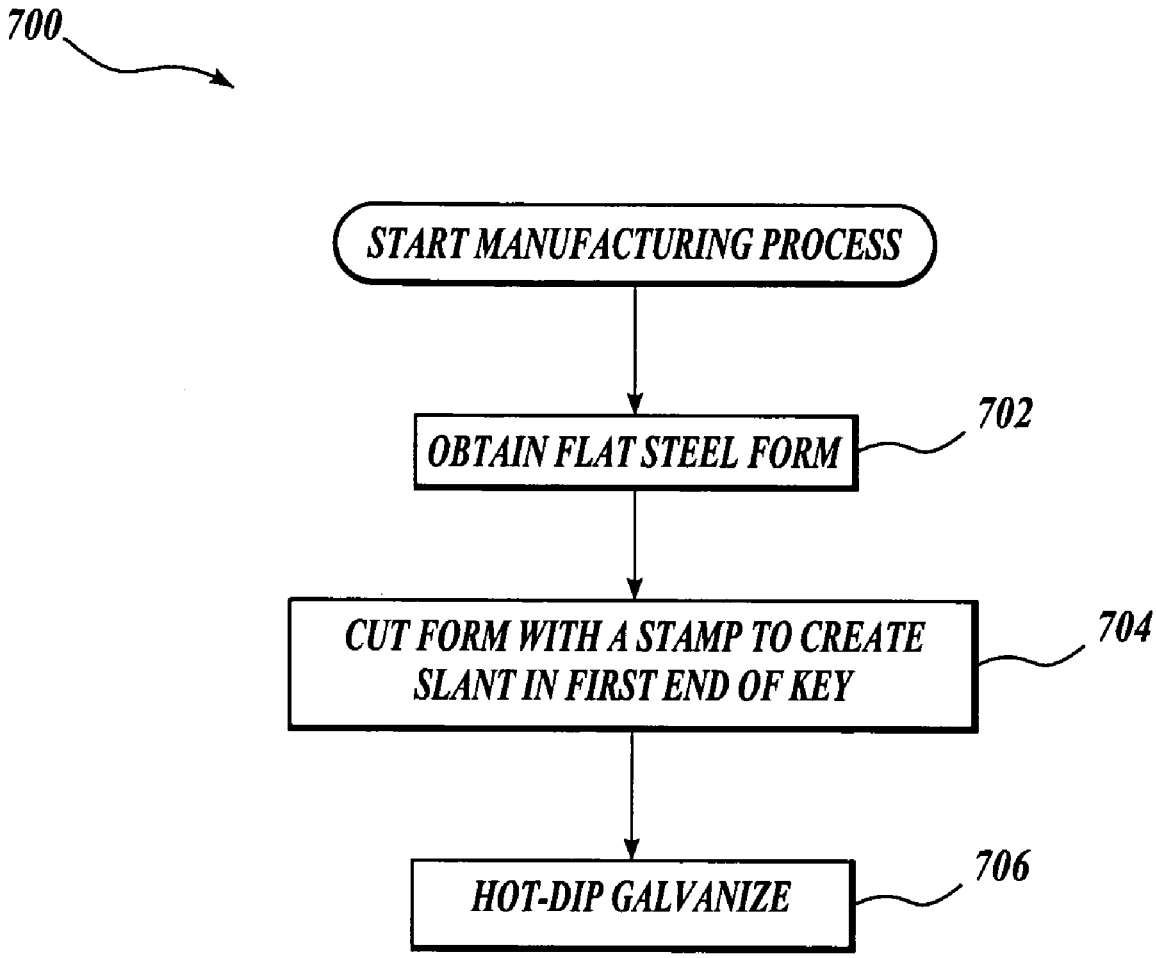
FIG. 7 is a process diagram of a method for manufacturing a key for a masonry coupling system in accordance with one embodiment of the present invention.

FIG. 7 shows a process diagram of a method 700 for manufacturing the key 400A for a masonry coupling system in accordance with one embodiment of this aspect of the invention. The method 700 for manufacturing a key 400A comprises the steps of obtaining a flat steel form of appropriate gauge and dimension. See block 702. The method 700 cuts the form with a stamp to cut out the body of the key including a slit in the first end of the key. See block 704. In some embodiments, the key 400A,B,C is dipped into a molten substance to form an alloy coating to provide cathodic protection. See block 706.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. In a system for coupling a masonry veneer to a structure, an anchor mounted on the structure, comprising:

a channel body having a channel bottom connected to two walls, a first wall of the two walls being projected substantially perpendicular to the channel bottom, and a second wall of the two walls being in parallel to the first wall, the second wall having a proximal end and a distal end, the proximal end being projected substantially perpendicular to the channel bottom and the distal end being projected inwardly toward the channel bottom at an acute angle of from about 30 degrees to about 60 degrees, wherein the second wall is projected substantially perpendicular to the channel bottom at a height greater than the first wall.

2. The anchor according to claim 1, wherein the channel body includes a plurality of fastener holes along its length.

3. The anchor according to claim 1, wherein the channel body is at least 1 inch in length.

4. The anchor according to claim 1, wherein the channel body comprises a non-corrosive material, the non-corrosive material being selected from a group consisting of stainless steel and hot-dip galvanized steel.

5. The anchor according to claim 4, wherein the hot-dip galvanized steel is in a gauge from about 11 to about 20.

6. The anchor according to claim 1, further comprising a coating of adhesive moisture proof material on the outer surface of the channel.

7. The anchor according to claim 6, further comprising a peelable backing covering the adhesive moisture proof material.

8. In a system for coupling a masonry veneer to a structure, a key that interfaces the masonry veneer and interlocks with an anchor mounted on the structure, comprising:

a substantially flat body with two ends, a first end of the substantially flat body having a slit to interlock with the anchor, and a second end of the substantially flat body having one or more openings for mortar capture, wherein the slit is slanted towards the anchor at an acute angle of from about 30 to about 60 degrees.

9. The key according to claim 8, wherein the first end comprises a first side and a second side, wherein the first side comprises a slit to interlock with the anchor and the second side further comprises a side cut.

10. The key according to claim 8, wherein the second end comprising one or more openings for mortar capture, the openings being selected from a group consisting of openings suitable for embedding seismic reinforcement wire and stamped tabs.

11. The key according to claim 8, wherein the body comprises hot dip galvanized steel in a gauge from about 11 to about 20.

12. A masonry coupling system, comprising:

at least one anchor mounted on a structure for coupling a masonry veneer to the structure, each anchor including a channel body having a bottom connected to two walls, a first wall of the two walls being projected substantially perpendicular to the bottom, and a second wall of the two walls in parallel to the first wall, the second wall having a proximal end and a distal end, the proximal end being projected substantially perpendicular to the bottom and the distal end being projected inwardly toward the channel bottom at an acute angle of from about 30 to about 60 degrees; and at least one key, each key interfacing with the masonry veneer and interlocking with at least one anchor mounted on the structure, each key including a substantially flat body with two ends, a first end of the substantially flat body having a slit to interlock with the anchor, and a second end of the substantially flat body having one or more openings for mortar capture wherein the slit is slanted towards the anchor at an acute angle of from about 30 to about 60 degrees.

13. The masonry coupling system according to claim 12, wherein the distal end of the second wall of the channel and the slit of the key each comprise a corresponding angle, the corresponding angle between about 40 to about 50 degrees.

14. The masonry coupling system according to claim 12, wherein the anchor is at least about 1 inch in length.

15. The masonry coupling system according to claim 12, wherein the anchor body comprises steel in a gauge from about 11 to about 20.

16. The masonry coupling system according to claim 15, wherein the anchor body comprises hot dip galvanized steel.

17. The masonry coupling system according to claim 12, further comprising a coating of adhesive material comprising a weatherproof protective membrane on the outer surface of the channel.

18. The masonry anchoring system according to claim 12, wherein the anchoring system comprises at least two anchors, and wherein each anchor is mounted to a structure in an alternate orientation with respect to the adjacent anchor.

19. A method for manufacturing a masonry coupling system, the method comprising:

shaping a first form to create an anchor, the anchor including a channel body having a length of at least 1 foot in length comprising a channel bottom connected to two walls, a first wall of the two walls being projected substantially perpendicular to the channel bottom, and a second wall of the two walls in parallel to the first wall, the second wall having a proximal end and a distal end, the proximal end being projected substantially perpendicular to the channel bottom, and the distal end being projected inwardly toward the channel bottom at an acute angle of from about 30 to about 60 degrees; and dipping the anchor into a molten substance to form an alloy coating to provide cathodic protection.

20. The method of claim 19, wherein the act of dipping includes dipping the anchor into a molten substance, the molten substance being selected from the group consisting of zinc and cadmium.

21. The method of claim 19, further comprising applying an adhesive layer comprising a weatherproof protective membrane over the length of the channel bottom of the channel body.

22. The method of claim 19, further comprising shaping a second form to create a key having a substantially flat body with two ends, a first end of the substantially flat body having a slit to interlock with the anchor, and a second end of the substantially flat body having one or more openings for mortar capture wherein the slit is slanted towards the anchor at an acute angle of from about 30 to about 60 degrees.

23. The method according to claim 19, wherein said flat steel form is at least 20 gauge steel.

24. The method of claim 23, further comprising dipping the key into the molten substance to form an oxide layer.

25. The anchor according to claim 1, wherein the second wall is projected substantially perpendicular to the channel bottom at a height approximately twice the height of the first wall.

26. The anchor according to claim 1, wherein the distal end of the second wall is projected toward the channel bottom at an acute angle from about 40 degrees to about 50 degrees.

27. The anchor according to claim 1, wherein the distal end of the second wall is projected toward the channel bottom at an acute angle of about 40 degrees to about 50 degrees.

28. The anchor according to claim 1, wherein the distal end of the second wall is projected toward the channel bottom at an acute angle of about 45 degrees.

29. The anchor according to claim 1, wherein the anchor is at least about 1 foot in length.

30. The key according to claim 8, wherein the slit is slanted toward the anchor at an angle of about 45 degrees.

31. The masonry coupling system according to claim 13, wherein the corresponding angle is about 45 degrees.

32. The masonry coupling system according to claim 12, wherein the anchor body is at least about 1 foot in length.

* * * * *